United States Patent [19]

Sheen

[11] Patent Number: 4,944,236

[45] Date of Patent: Jul. 31, 1990

[54] TUNNEL TYPE GARBAGE INCINERATOR

[76] Inventor: Chao-Chin Sheen, 283, Sec. 4, Fu-Hsin Rd., Taichung, Taiwan

[21] Appl. No.: 398,274

[22] Filed: Aug. 24, 1989

[51] Int. Cl.[5] ..... F23G 5/00; F23G 5/12; F23G 5/44

[52] U.S. Cl. ..... 110/257; 110/235; 110/255; 432/241

[58] Field of Search ..... 110/257, 259, 235; 432/241

[56] References Cited

U.S. PATENT DOCUMENTS 2,912,941 11/1959 Hughes et al. ..... 110/257 X
4,836,777 6/1989 Elliott ..... 432/241

*Primary Examiner*—Edward G. Favors
*Attorney, Agent, or Firm*—Larson and Taylor

[57] ABSTRACT

The present invention provides a tunnel type garbage incinerator, which is characterized that the garbages are first classified into combustible and incombustible materials, then the combustible materials are loaded on a bogie and fed into the incinerating tunnel for incineration, the fore section of the incinerating tunnel is used for drying combustible materials, the middle section of the incinerating tunnel is used for the bleast incineration of the combustible material, the aft section of the incinerating tunnel is used for the cooling and output port of the incinerated materials or ashes. In which, the incinerating tunnel is furnished with blowers, flame igniting device, smoke processing device, and through proper arrangement of the components, the garbages can be completely combusted with minimal fuel oil consumption, furthermore, since the smoke is filtered before it is expelled, it does not produce air pollution.

3 Claims, 4 Drawing Sheets

TUNNEL TYPE GARBAGE INCINERATOR

BACKGROUND OF THE INVENTION

In a conventional garbage incinerator, the garbage is dumped into it, after which the flames of ignited fuel oil mist mix with a large amount of fresh air directed onto the garbage to assist combustion. Since garbage is piled up due to dumping which causes the interior portion of the pile of garbage to be incompletely combusted, a large amount of smoke is generated which overloads the smoke filtration equipment while producting incomplete filtration. Further, when new garbage is dumped into the incinerator, the temperature of the incinerator will tend to decrease; but when the new garbage is set on fire, the temperature of the incinerator will tend to increase. These swiftly changing temperature increases and decreases inside of the incinerator will introduce damage to the incinerator structure. In addition to these shortcomings, the ashes produced inside of the conventional garbage incinerator will frequently cause blockage to the fresh air current incoming passage which in turn prevents the remaining garbage from being completely combusted. Also, the ashes should be taken out from the bottom of the incinerator which forms another disadvantage in the traditional garbage incinerator. The present invention solves all of the above disadvantages.

SUMMARY OF THE INVENTION

The object of the present invention is to provide a tunnel type garbage incinerator which is characterized in that all of the component structures of this incinerator are constructed and deployed in a land area. In the vicinity of the input port of the incinerator, it is furnished with a garbage storage ground. The garbage is then crushed in a crusher, metal is separated by a metal separator and gravel is separated by a vibrating sieve. Through these processes, the garbage is separated into combustible and incombustible materials. Thereafter, the combustible material is loaded on a bogie and fed into the incinerating tunnel of the incinerator for combustion. The incinerating tunnel of the incinerator is about 100 to 140 meters in length, the middle section of this incinerating tunnel is used as the incinerating chamber which is provided with plurality of flaming nozzles for igniting the combustible material, the tail section of this incinerating tunnel is provided with plurality of blowers, and near the fore section this incinerating tunnel, it is provided with an exhaust gas outlet port connecting to a water rinsing pool, this water rinsing pool is provided with a plurality of water splashing wheels near the water surface and a plurality of water spraying nozzles in the space above the water surface for rinsing or filtering out the smoke and dust contents in the exhausted gas, and the water rinsing pool has a drainage pipe line which guides the used water to flow into a sedimentary pool for water purification, after which it is pumped back to the water rinsing pool for reuse. On the side wall above the water surface of the water rinsing pool, it is provided with an exhaust blower which pumps the filtrated exhaust gas out from water rinsing pool to the smokestack for emission, in this manner, the exhausted gas emission of this incinerator can meet the regulated emission standards.

The garbage can be completely incinerated inside of the tunnel type incinerator due to the specific stuctural features thereof. Its fore section possesses a strong drying out capability. Therefore, a small amount of fuel oil is needed to ignite the garbage into full combustion and its tail section is used as both a fresh air input port and an outlet port for bogies with incinerated material ash. Thereafter, the fresh air is preheated before it goes to the incinerating chamber by absorbing heat energy from the outgoing bogies and ashes, thereby saving fuel oil. Furthermore, sicne it is a continuous process, it can handle large amounts of garbage.

DETAILED DESCRIPTION OF THE PREFERRED EMBODIMENTS

Figure 1:
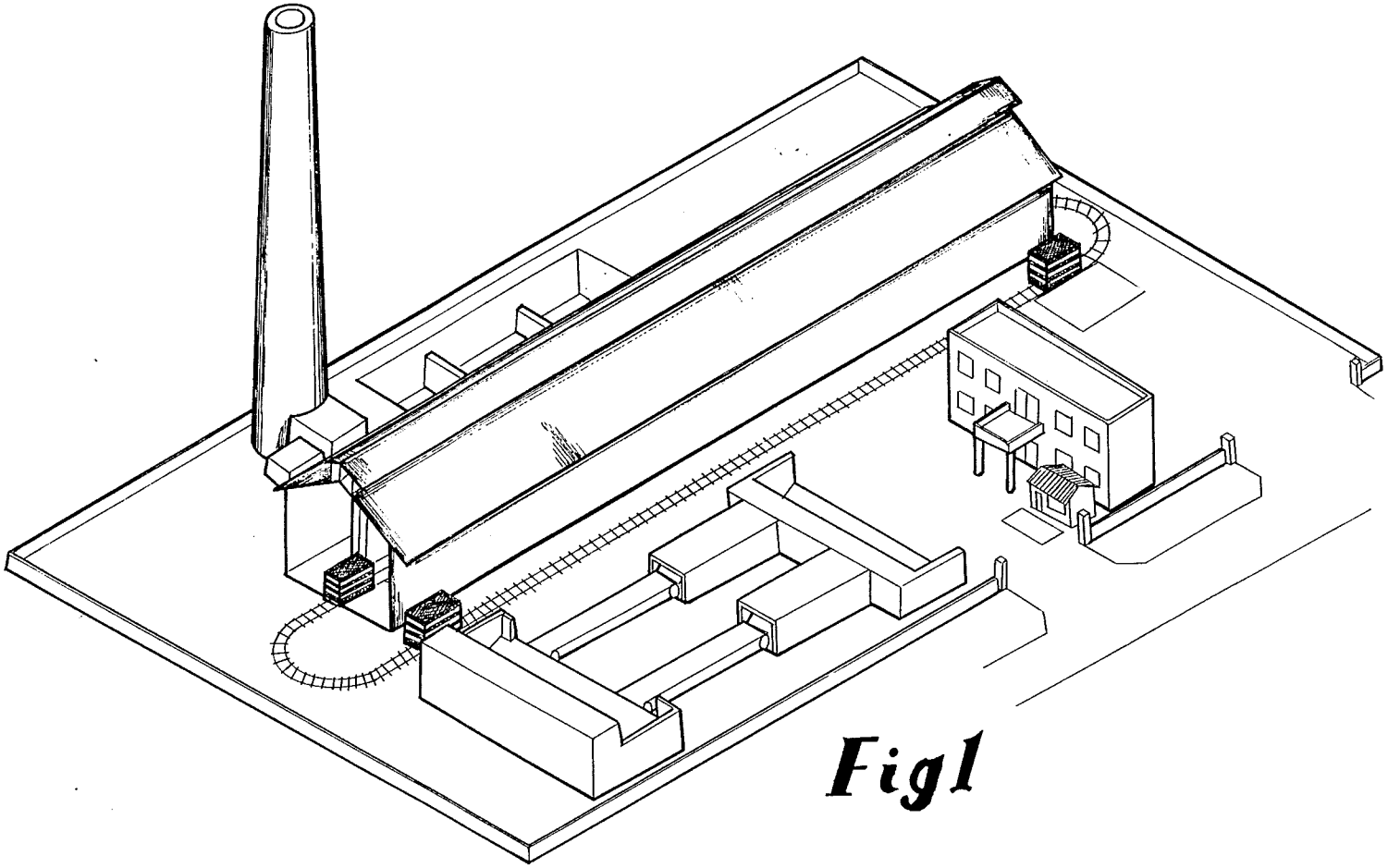
FIG. 1 is a perspective view of the configuration of the present invention.

Referring to FIG. 1, which shows that the present invention is installed on a land area, at the front thereof near the input port it is provided with a garbage storage ground. The garbage is crushed in a crushing unit A and then fed into a metal selecting unit B for metal separation after which it is fed to a vibrating sieve C for gravel separation. Through these processes, the garbage is separated into combustible and incombustible materials. Thereafter, the combustible materials are loaded on bogies 1 and fed into the incinerating tunnel 2 via track 11. The incinerating tunnel has a length about 120 to 140 meters, its middle section is used as a incinerating chamber 21 by providing plurality of flaming nozzles for igniting the combustible materials into combustion. In the vicinity of the tail section of the incinerating tunnel, it is provided with plurality of fresh air feeding blowers 22, and in the vicinity of the fore section of the incinerating tunnel, it is provided with an exhaust gas outlet port 23 connecting to a water rinsing pool 3, while the water rinsing pool 3 is provided with one or a plurality of water splashing wheels 31 near the water surface and plurality of water spraying nozzles 32 in the space above the water surface, and the water rinsing pool 3 has a drainage pipe line which goes to the low-leveled sedimentary water purification pool 4, the purified water is then pumped back into the water rinsing pool 3 for reuse by a water pump 5, the side wall above the water surface of the water rinsing pool 3 is provided with a blower 6 which draws out the smoke and solid dust particles removed or filtrated exhaust gas from the water rinsing pool 3 and feeds it into the smokestack 7 for emission, also on the inner wall of the smokestack 7 it is provided with helical upward extending water pipe lines 71 having a plurality of water spraying orifices for further smoke and solid dust particles filtration contained in the exhaust gas.

Figure 2:
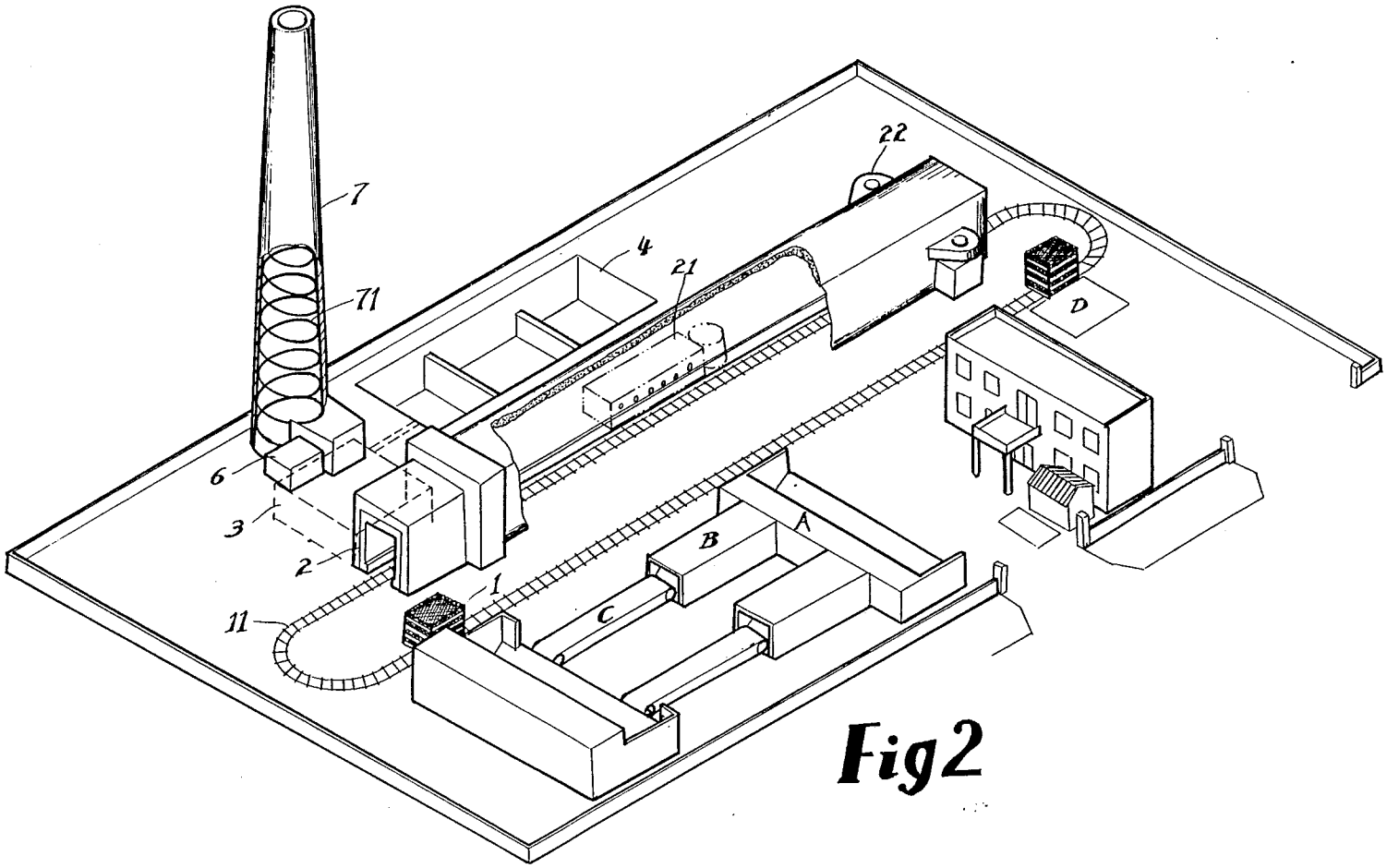
FIG. 2 is a perspective view of the configuration of the present invention with the incinerating tunnel partially cut away.
Figure 3:
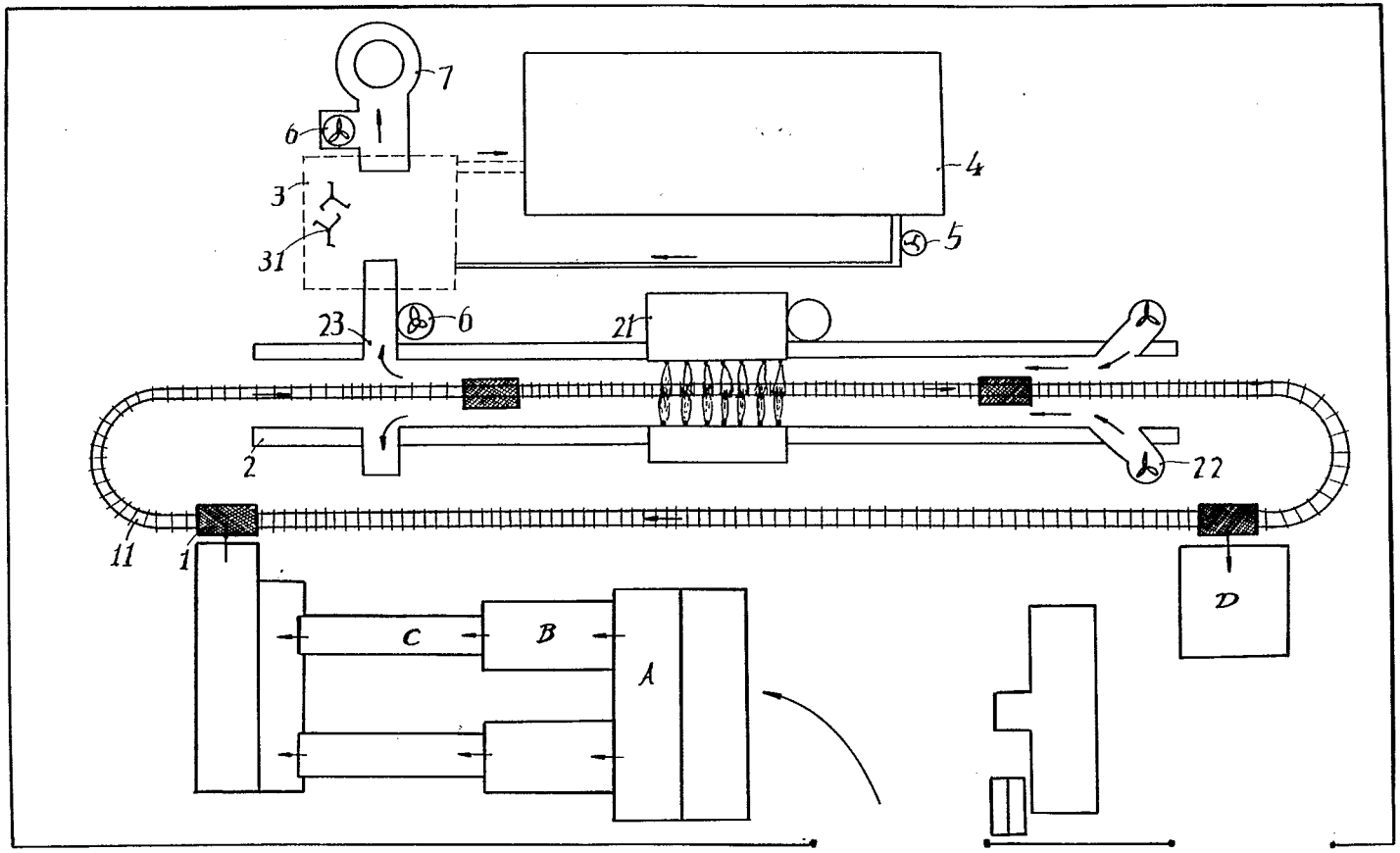
FIG. 3 is a top plan view of the configuration of the present invention with water, material and airflow indicators.
Figure 5:
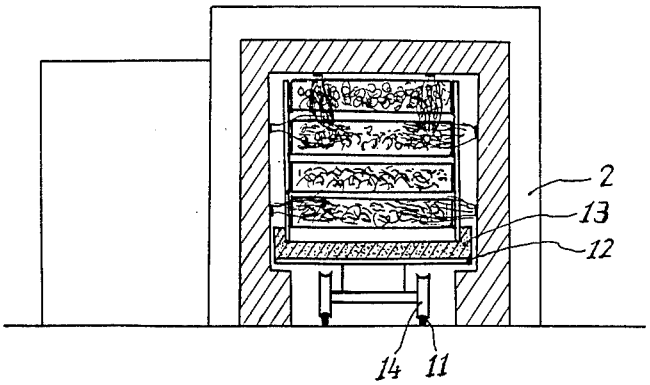
FIG. 5 is a sectional view of the incinerating chamber of the present invention showing a loaded bogie located inside of the chamber.
Figure 4:
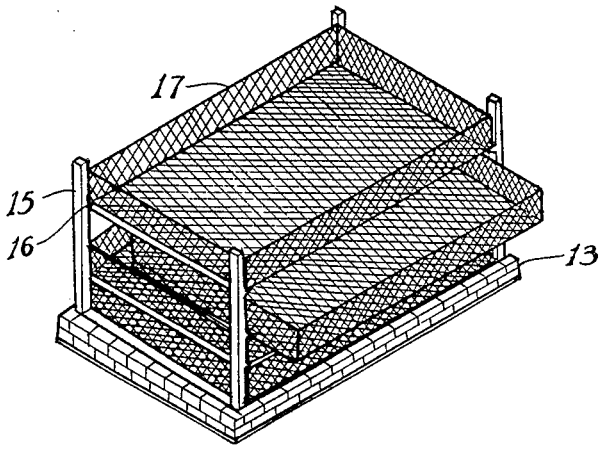
FIG. 4 is a perspective view of a bogie of the present invention.

Referring to FIG. 2 and 3, the combustible garbage is loaded onto boggies 1 and is fed into the incinerating tunnel 2 via the trap 11. The bogie 1 is of conventional construction but its top platform 12 is laid with fire bricks 13 and the platform 12 is wider than the wheel track 14. At the four corners of the platform 12 of each bogie 1 there is provided a support rod 15. Between these suppport rods 15 there are a plurality of layers of horizontal guide rails 16. Combustible material loaded mesh buckets 17 can be placed in these layers on the platform by sliding them into the respective layers of the guide rails 16. The tunnel 2 is formed into a special profile as shown in FIG. 4 which mates with the upper portion of each bogie, including the platform of the bogie 12 which is thereby encased by adjacent side walls of the incinerating chamber 21. Meanwhile, it is thermally insulated from the lower portion including the wheels 14 of the bogie 12. In this manner, when the garbage loaded on the upper portion of the bogies 12 is incinerated inside the incinerating chamber 21, the lower portion of the bogie 12 will not be heated violently. Since fresh air is supplied continuously to the incinerating chamber 21 from the tail section of the incinerating tunnel 2 by the blowers 22, and the exhaust gas of combustion produced in the incinerating chamber 21 is sucked out via the exhaust gas outlet port 23, so that the high temperature exhaust gas travels from the incinerating chamber 21 toward the fore section of the incinerating tunnel 2 which dries out the combustible materials gradually as the bogies move toward the incinerating chamber 21, when the incinerating chamber 21 is completely dried out and can be completely burnt into ashes, then the ashes are collected into the trough 12 formed by fire-bricks laid on platform 12 from free fallen. As the bogies 1 keep moving toward the tail portion of the incinerating tunnel 2, they are cooled by the fresh and cool air current from blower 22 as well as the fresh and cool air current is pre-heated by the hot bogies 1 before they reach the incinerating chamber for better incineration. The ashes collected in the bogies 1 are dumped into the ashes storage pool D for shipping out (the ashes can be used as fertilizer, or solidified for other use), then, the bogies are returned to the loading station for re-loading of the combustible materials. Furthermore, the exhaust gas generated in the incinerating chamber 21 is sucked into the water rinsing pool 3 by exhaust blower 6 via the exhaust gas outlet port 23, after passing through the water rinsing pool 3, the smoke and the solid dust particles as well as the bed smell gas contents of the exhaust gas are filtrated out by the splashing and spraying water drops and mist generated by the plurality of water splashing wheels and water spraying nozzles, then this purified exhaust gas is sucked out to the smokestack 7 for emission by the exhaust blower 6, inside the smokestack 7. This purified exhaust gas is once more rinsed by water mist generated by water pipe line and its spraying orifices located on the inner wall of the smokestack 7, so that the emission of the exhaust gas from the smokestack 7 meets the regulated emission standards. In addition, the used water of the water rinsing pool 3 and the used water collected at the bottom of the smokestack 7 are drained into a low-level sedimentary pool 4 for purification (the sediment is removed periodically), then, this purified water is pumped back to the water rinsing pool 3 and the smokestack water rinsing pipe line for reuse. Of course, methods other than the water rinsing method can be used for smoke, solid particles, and bed smell gas removal for air pollution prevention, but they are not the main point of the present invention and therefore they are omitted.

Based on the above discussion, the most important feature of the present invention is that the tunnel type incinerator can make the combustible garbage completely burnt into ashes since the fore section of the incinerating tunnel of the present invention possesses a high drying out capability. Before the combustible garbage is fed into the incinerating chamber, it is competely dried out. Therefore, only a small amount of fuel oil is required to ignite the garbage into full combustion and the tail section of the same incinerating tunnel provides both functions so as to cool out the bogies and preheat the fresh and cool air current which serves both combustion assisting and oil fuel solving purposes. In addition to these advantages, since the present invention is based on continuous cyclic operation, it can handle a large amount of garbage in a short time.

I claim:

1. A tunnel type garbage incinerator which is characterized in that all of the component structures of this incinerator are constructed and deployed on a land area, comprising:

a garbage classification plant furnished with a crushing unit, a metal selecting unit, and a gravel sifting unit;

an incinerating tunnel having a length of about 120 to 140 meters;

a plurality of bogies;

an endless rail track passing through the said incinerating tunnel for guiding the travel of the bogies;

each bogie being provided with a fire brick platform, the upper portion of each bogie above the said platform being wider than the wheel track beneath it and closely encased by two adjacent side walls of the incinerating tunnel when the bogie travels into the incinerating tunnel, the middle section of the incinerating tunnel being an incinerating chamber, and a plurality of flame nozzles provided on the upper portions of each side wall, the tail section near the outlet port of the said incinerating tunnel being provided with a plurality of fresh air blowers, the fore section near the input port of the incinerating tunnel being provided with an exhaust gas outlet port;

a water rinsing pool and a smokestack;

and wherein the exhaust gases generated in the incinerating chamber are sucked out from the incinerating tunnel into the smokestack for emission into the air after passing through the water rinsing pool and the smokestack water rinsing device for filtering out smoke, solid particles and bad smelling gases contained in the untreated exhaust gases.

2. A tunnel garbage incinerator as set forth in claim 1, in which the four corners of the platform of the bogie are provided with respective vertical support rods, and wherein, between these support rods there are provided a plurality of horinzontal guide rails, and including combustible material loaded into mesh buckets mountable layer by layer on the platform by sliding them into respective layers of the guide rails.

3. A tunnel garbage incinerator as set forth in claim 1, in which the interior of the smokestack is provided with a helical water pipeline having a plurality of water spraying orifices.

* * * * *